US012492546B1

(12) United States Patent
Mehrabi et al.

(10) Patent No.: US 12,492,546 B1
(45) Date of Patent: Dec. 9, 2025

(54) SYSTEMS AND METHODS FOR CONNECTING UHPC STRUCTURAL ELEMENTS

(71) Applicants: Armin Barzegar Mehrabi, Miami, FL (US); Michael Odelola, Miami, FL (US); Seyed Saman Khedmatgozar Dolati, Miami, FL (US)

(72) Inventors: Armin Barzegar Mehrabi, Miami, FL (US); Michael Odelola, Miami, FL (US); Seyed Saman Khedmatgozar Dolati, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 0 days.

(21) Appl. No.: 19/077,849

(22) Filed: Mar. 12, 2025

(51) Int. Cl.
*E04B 1/21* (2006.01)
*E04B 1/00* (2006.01)
*E04B 1/48* (2006.01)

(52) U.S. Cl.
CPC ..... *E04B 1/215* (2013.01); *E04B 1/48* (2013.01); *E04B 1/483* (2013.01); *E04B 2103/02* (2013.01)

(58) Field of Classification Search
CPC . E04B 1/215; E04B 1/48; E04B 1/483; E04B 2103/02
USPC ..... 52/848
See application file for complete search history.

(56) References Cited

U.S. PATENT DOCUMENTS 991,722 A * 5/1911 Hourd ..... E04B 1/48 403/268
1,491,404 A * 4/1924 Houghton ..... E04B 1/26 52/591.4
2,535,263 A * 12/1950 Budne ..... E04B 1/215 403/173
3,117,358 A * 1/1964 Kitchen ..... E04G 17/02 249/188
3,722,159 A * 3/1973 Kessler ..... E04B 1/215 52/283
3,745,731 A * 7/1973 Simpson ..... E04B 1/20 52/283

(Continued)

FOREIGN PATENT DOCUMENTS

AU 2009222558 A1 * 10/2009 ..... E01C 11/126
BR 102013022056 A2 * 4/2015 ..... E04C 2/06

(Continued)

OTHER PUBLICATIONS

Odelola, Michael, et al. "Alternative Splicing Options for Ultra-High-Performance Concrete (UHPC) H-Piles." Buildings 15.3 (2025): 481.

*Primary Examiner* — Brian D Mattei
*Assistant Examiner* — Joseph J. Sadlon
(74) *Attorney, Agent, or Firm* — SALIWANCHIK, LLOYD & EISENSCHENK

(57) ABSTRACT

Systems and methods for connecting (and/or splicing) ultra-high-performance concrete (UHPC) precast elements are provided, as well as the finished connected UHPC elements after connection. The UHPC precast elements can be designed for applications in building construction and/or civil engineering. Overhang connection structures and spar connection structures are provided. In either case, holes can be created in one UHPC beam segment (e.g., by casting or drilling) to accommodate dowel bars from a corresponding UHPC segment.

8 Claims, 6 Drawing Sheets

(56) References Cited

U.S. PATENT DOCUMENTS 3,759,003 A * 9/1973 Wilson ..... E04B 2/12 52/285.4
3,783,565 A * 1/1974 Hughes ..... E04B 1/215 52/283
3,892,096 A * 7/1975 Macchi ..... E01D 21/06 52/223.11
3,950,902 A * 4/1976 Stout ..... E04B 1/161 52/607
4,070,848 A * 1/1978 Lingle ..... F25D 23/063 52/584.1
4,123,888 A * 11/1978 Kajava ..... E04B 1/21 52/848
4,395,854 A * 8/1983 White ..... E04B 2/827 160/40
5,012,622 A * 5/1991 Sato ..... E04B 1/30 52/848
5,433,049 A * 7/1995 Karlsson ..... E04B 1/0007 52/294
5,466,086 A * 11/1995 Goto ..... F16B 13/141 403/267
5,560,174 A * 10/1996 Goto ..... F16B 12/04 403/267
5,688,069 A * 11/1997 Hoshino ..... E04B 1/215 403/339
6,120,207 A * 9/2000 Goto ..... F16B 11/006 403/268
6,416,253 B1 * 7/2002 Wimp ..... F16L 1/123 405/35
6,679,017 B2 * 1/2004 Woodruff, III ..... E04B 1/215 403/360
6,751,821 B1 * 6/2004 Han ..... E04C 3/26 52/223.8
7,661,228 B1 * 2/2010 Nolte ..... E04B 7/20 52/579
7,669,333 B2 * 3/2010 van Rijn ..... E04G 21/142 29/897.34
8,079,189 B2 * 12/2011 Qu ..... E04B 1/161 52/251
8,806,820 B2 * 8/2014 Ahn ..... B28B 1/002 52/848
9,404,254 B2 * 8/2016 Reigstad ..... E04B 5/32
9,650,784 B2 * 5/2017 Jensen ..... E04B 2/18
9,765,517 B2 * 9/2017 Gramola ..... E04H 9/025
10,094,101 B1 * 10/2018 Jazzar ..... E04C 3/34
10,138,616 B2 * 11/2018 Hu ..... E04B 1/16
10,138,630 B1 * 11/2018 Sarda ..... E04B 2/86
10,227,769 B2 * 3/2019 Catteau ..... E04B 1/003
10,378,199 B2 * 8/2019 Calderon Uriszar-Aldaca ..... E04B 1/388
10,689,839 B2 * 6/2020 Wheatley ..... E04B 1/383
10,709,917 B2 * 7/2020 An ..... E04B 1/94
10,718,114 B2 * 7/2020 Park ..... C04B 28/02
10,760,260 B2 * 9/2020 Yin ..... E04B 1/04
11,066,826 B2 * 7/2021 Wright ..... E04B 1/7654
11,168,476 B1 * 11/2021 Tadros ..... E04B 5/043
11,377,841 B2 * 7/2022 Kurosawa ..... E04B 1/215
11,828,033 B1 * 11/2023 Khedmatgozar Dolati ..... E02D 5/526
11,891,802 B2 * 2/2024 Stretch ..... B28B 23/04
12,123,451 B2 * 10/2024 Nill ..... F16B 35/041
12,312,795 B1 * 5/2025 Ren ..... E04B 1/043
12,435,509 B2 * 10/2025 Hooper ..... E04G 17/06
2002/0062616 A1 * 5/2002 Ocampo ..... E04B 1/215 52/261
2006/0059841 A1 * 3/2006 Bennett ..... E04B 1/215 52/649.1
2009/0300861 A1 * 12/2009 Yamamoto ..... E01D 19/125 411/386
2011/0061316 A1 * 3/2011 Tonyan ..... E02D 27/02 52/294
2011/0302880 A1 * 12/2011 DiPietro ..... B28B 23/005 52/834
2012/0060438 A1 * 3/2012 Jensen ..... E04B 2/44 52/742.13
2014/0190113 A1 * 7/2014 Azad ..... E04C 5/07 29/897.35
2016/0002910 A1 * 1/2016 Green ..... E04B 1/2403 52/848
2019/0169846 A1 * 6/2019 Azizinamini ..... B28B 7/342
2019/0257043 A1 * 8/2019 Azizinamini ..... E01D 19/10
2020/0123760 A1 * 4/2020 Garcia-Abril Ruiz .. E04B 1/167
2021/0229319 A1 * 7/2021 Royce ..... E04B 5/06
2021/0348377 A1 * 11/2021 Scott ..... E04B 5/023
2022/0356703 A1 * 11/2022 Royce ..... B28B 23/046
2023/0044480 A1 * 2/2023 Connell ..... E04B 1/4121
2023/0349113 A1 * 11/2023 Shao ..... E01D 2/04
2023/0349114 A1 * 11/2023 Shao ..... E01D 19/02
2024/0200320 A1 * 6/2024 Butler ..... E04B 1/48
2024/0209619 A1 * 6/2024 Sanabra Loewe ..... E04B 1/043

FOREIGN PATENT DOCUMENTS

CN 107882271 A * 4/2018 ..... E04C 3/34
CN 110219486 A * 9/2019 ..... E04B 1/21
CN 112196100 A * 1/2021 ..... E04H 9/025
CN 112252586 A * 1/2021 ..... B28B 1/14
CN 112391931 A * 2/2021 ..... E01D 19/00
CN 112900620 A * 6/2021 ..... E04C 3/34
CN 215926476 U * 3/2022
CN 115162609 A * 10/2022 ..... E02D 5/76
CN 118309111 A * 7/2024 ..... E02D 31/08
EP 1323876 A1 * 7/2003 ..... E04B 7/22
KR 1267807 B1 * 6/2013 ..... B28B 1/002
WO WO-03090582 A1 * 11/2003 ..... A47B 57/482
WO WO-2006095052 A1 * 9/2006 ..... E04B 2/703
WO WO-2014118713 A1 * 8/2014 ..... E04B 1/215

* cited by examiner

SYSTEMS AND METHODS FOR CONNECTING UHPC STRUCTURAL ELEMENTS

BACKGROUND

Precast concrete elements are gaining popularity in building and civil engineering projects due to their ability to speed up the construction process. Construction projects can use ultra-high-performance concrete (UHPC) and can feature innovative shapes, such as H-shaped cross sections, to meet the construction and engineering specifications. Splicing refers to the various methods used to connect precast segments during construction, and different methods can be considered for different reasons, including transportation, length requirements, construction methodology, and strength capacity. Splicing can be executed for preplanned connections prepared at the precast plant or for unplanned connections made on-site during installation. A range of connection types are available, including welding, bolting, and dowelling.

BRIEF SUMMARY

Embodiments of the subject invention provide novel and advantageous systems and methods for connecting (and/or splicing) ultra-high-performance concrete (UHPC) precast elements, as well as the finished connected UHPC elements after connection. The UHPC precast elements can be designed for applications in building construction and/or civil engineering. Embodiments include overhang connection structures and spar connection structures. In either case, holes can be created in one UHPC beam segment (e.g., by casting or drilling) to accommodate dowel bars from a corresponding UHPC segment.

In an embodiment, a method for connecting concrete structural elements can comprise: casting a first concrete structural element (e.g., UHPC (precast) structural element) with dowel bars extending from a first face of the first concrete structural element; casting a second concrete structural element (e.g., UHPC (precast) structural element) with dowel holes formed in a second face of the second concrete structural element, the dowel holes being configured to respectively receive the dowel bars of the first concrete structural element; applying an adhesive material (e.g., epoxy, UHPC, and/or bonding grout) to the dowel holes of the second concrete structural element; after applying the adhesive material, connecting the first concrete structural element to the second concrete structural element by respectively inserting the dowel bars of the first concrete structural element into the dowel holes of the second concrete structural element (e.g., such that the first face comes into direct physical contact with the second face); and allowing the adhesive material to cure while the dowel bars of the first concrete structural element are respectively inserted into the dowel holes of the second concrete structural element. The first concrete structural element and the second concrete structural element can comprise a complementary connection structure that is either an overhang connection structure (see also FIGS. 1, 3, and 5) or a spar connection structure (see also FIGS. 2, 4, and 6). The first concrete structural element and the second concrete structural element can each have an H-shaped cross section, such that the first face of the first concrete structural element has an H-shape and the second face of the second concrete structural element has an H-shape. The first concrete structural element and the second concrete structural element can each be a beam, a column, a pile, a panel element, a slab, or a wall element. In the case of the complementary connection structure being the overhang connection structure: the first concrete structural element can comprise a third face opposite from the first face of the first concrete structural element; the first face of the first connection structure can comprise a first extended portion and a first non-extended portion such that the first extended portion of the first face extends farther from the third face of the first concrete structural element than does the first non-extended portion (e.g., the first concrete structural element can be cast this way); the second concrete structural element can comprise a fourth face opposite from the second face of the second concrete structural element; the second face of the second connection structure can comprise a second extended portion and a second non-extended portion such that the second extended portion of the second face extends farther from the fourth face of the second concrete structural element than does the second non-extended portion (e.g., the second concrete structural element can be cast this way); and the first extended portion and the first non-extended portion can be configured to match up with the second non-extended portion and the second extended portion, respectively, when the first concrete structural element is connected to the second concrete structural element, thereby providing the overhang connection structure (e.g., the first extended portion and the first non-extended portion can be in direct physical contact with the second non-extended portion and the second extended portion, respectively, when the first concrete structural element is connected to the second concrete structural element). The first extended portion can be extended away from the first non-extended portion by a first length; the second extended portion can be extended away from the second non-extended portion by a second length; and the first length can be the same (or about the same) as the second length. The dowel bars can be formed on both the first extended portion and the first non-extended portion, and the dowel holes can be formed on both the second extended portion and the second non-extended portion. A quantity of the dowel bars on the first extended portion can be equal to a quantity of the dowel bars on the first non-extended portion (and therefore a quantity of the dowel holes on the second extended portion can be equal to a quantity of the dowel holes on the second non-extended portion). In the case of the complementary connection structure being the spar connection structure: the method can further comprise disposing a spar plate (which can have a plate shape as seen in FIGS. 2 and 4) on the first concrete structural element extending from the first face of the first concrete structural element, and forming a spar cavity in the second face of the second concrete structural element. The spar cavity can be configured to receive the spar plate of the first concrete structural element, thereby providing the spar connection structure. The spar plate can be disposed between a first portion of the dowel bars and a second portion of the dowel bars (e.g., it can be disposed at or near a center of the first face vertically), and the spar cavity can be disposed between a first portion of the dowel holes and a second portion of the dowel holes (e.g., it can be disposed at or near a center of the second face vertically). The method can further comprise, before connecting the first concrete structural element to the second concrete structural element, applying the adhesive material to the spar cavity of the second concrete structural element. The connecting of the first concrete structural element to the second concrete structural element can further comprise inserting the spar plate of the first concrete structural element into the spar cavity of the second concrete structural element. A length of the dowel bars (i.e., how far they extend away from the first face) can be the same or substantially the same as a depth of the dowel holes, respectively. For example, a length of the dowel bars can be at least 90% of the depth of the dowel holes (e.g., in a range of from 90% to 100%, or 95% to 100%, or 97% to 100%, of the depth of the dowel holes). A length of the spar plate (if present) (i.e., how far it extends away from the first face) can be the same or substantially the same as a depth of the spar cavity. For example, a length of the spar plate can be at least 90% of the depth of the spar cavity (e.g., in a range of from 90% to 100%, or 95% to 100%, or 97% to 100%, of the depth of the spar cavity).

In another embodiment, a system for connecting concrete structural elements can comprise: a first concrete structural element (e.g., UHPC (precast) structural element) comprising dowel bars extending from a first face of the first concrete structural element; a second concrete structural element (e.g., UHPC (precast) structural element) comprising dowel holes formed in a second face of the second concrete structural element, the dowel holes being configured to respectively receive the dowel bars of the first concrete structural element; and a complementary connection structure that is either an overhang connection structure or a spar connection structure. The first concrete structural element and the second concrete structural element can each have an H-shaped cross section, such that the first face of the first concrete structural element has an H-shape and the second face of the second concrete structural element has an H-shape. The first concrete structural element and the second concrete structural element can each be a beam, a column, a pile, a panel element, a slab, or a wall element. In the case of the complementary connection structure being the overhang connection structure: the first concrete structural element can comprise a third face opposite from the first face of the first concrete structural element; the first face of the first connection structure can comprise a first extended portion and a first non-extended portion such that the first extended portion of the first face extends farther from the third face of the first concrete structural element than does the first non-extended portion; the second concrete structural element can comprise a fourth face opposite from the second face of the second concrete structural element; the second face of the second connection structure can comprise a second extended portion and a second non-extended portion such that the second extended portion of the second face extends farther from the fourth face of the second concrete structural element than does the second non-extended portion; and the first extended portion and the first non-extended portion can be configured to match up with the second non-extended portion and the second extended portion, respectively, when the first concrete structural element is connected to the second concrete structural element, thereby providing the overhang connection structure (e.g., the first extended portion and the first non-extended portion can be in direct physical contact with the second non-extended portion and the second extended portion, respectively, when the first concrete structural element is connected to the second concrete structural element). The first extended portion can be extended away from the first non-extended portion by a first length; the second extended portion can be extended away from the second non-extended portion by a second length; and the first length can be the same (or about the same) as the second length. The dowel bars can be formed on both the first extended portion and the first non-extended portion, and the dowel holes can be formed on both the second extended portion and the second non-extended portion. A quantity of the dowel bars on the first extended portion can be equal to a quantity of the dowel bars on the first non-extended portion (and therefore a quantity of the dowel holes on the second extended portion can be equal to a quantity of the dowel holes on the second non-extended portion). In the case of the complementary connection structure being the spar connection structure: the first concrete structural element can comprise a spar plate (which can have a plate shape as seen in FIGS. 2 and 4) extending from the first face of the first concrete structural element; and the second concrete structural element can comprise a spar cavity in the second face of the second concrete structural element. The spar cavity can be configured to receive the spar plate of the first concrete structural element, thereby providing the spar connection structure. The spar plate can be disposed between a first portion of the dowel bars and a second portion of the dowel bars (e.g., it can be disposed at or near a center of the first face vertically), and the spar cavity can be disposed between a first portion of the dowel holes and a second portion of the dowel holes (e.g., it can be disposed at or near a center of the second face vertically). The dowel bars of the first concrete structural element can be respectively inserted into the dowel holes of the second concrete structural element such that the first concrete structural element is connected to the second concrete structural element (e.g., such that the first face comes into direct physical contact with the second face); and the system can further comprise a cured adhesive material (e.g., epoxy, UHPC, and/or bonding grout) disposed in the dowel holes (and in the spar cavity, if present) and in (physical) contact with the dowel bars (and the spar plate, if present). A length of the dowel bars (i.e., how far they extend away from the first face) can be the same or substantially the same as a depth of the dowel holes, respectively. For example, a length of the dowel bars can be at least 90% of the depth of the dowel holes (e.g., in a range of from 90% to 100%, or 95% to 100%, or 97% to 100%, of the depth of the dowel holes). A length of the spar plate (if present) (i.e., how far it extends away from the first face) can be the same or substantially the same as a depth of the spar cavity. For example, a length of the spar plate can be at least 90% of the depth of the spar cavity (e.g., in a range of from 90% to 100%, or 95% to 100%, or 97% to 100%, of the depth of the spar cavity).

BRIEF DESCRIPTION OF DRAWINGS

FIG. 1 depicts prepared matching precast elements with an overhang, dowel bars, and holes.

FIG. 2 depicts prepared matching precast elements with a spar, dowel bars, and holes.

FIG. 3 depicts alignment of the prepared matching precast elements.

FIG. 4 depicts alignment of the matching precast elements with the spar plates and dowel bars in preparation for the connection.

FIG. 5 depicts the system after adhesive and/or grout has been applied to the connection point to form the finished connected elements.

FIG. 6 depicts the system after application of adhesive and/or grout to the connection point to form the finished connected beam.

DETAILED DESCRIPTION

Embodiments of the subject invention provide novel and advantageous systems and methods for connecting (and/or splicing) ultra-high-performance concrete (UHPC) precast elements (e.g., elements with an H-shaped cross section), as well as the finished connected UHPC elements after connection. The UHPC precast elements can be designed for applications in building construction and/or civil engineering. Embodiments include overhang connection structures and spar connection structures. In either case, holes can be created in one UHPC beam segment (e.g., by casting or drilling) to accommodate dowel bars from a corresponding UHPC segment (see also FIGS. 1 and 2). While dowel connections have been used in conjunction with structural elements made of other materials and configuration, such connections have not been previously used for elements made of UHPC materials and specifically for elements with H-shaped cross sections.

Effective splicing of precast elements solves many construction challenges, including reducing issues with time, handling, and transportation. Proper splicing eliminates (or attenuates) the need for precise length predictions, and it allows for easy element extensions when needed. Effective connection methods should be effective without a significant increase in the project time, while also being durable and cost effective. No effective related art connection system exists for joining UHPC structural elements. The only type of related art connection for joining H-shaped UHPC precast elements uses welded connections, which is plainly different from embodiments of the subject invention, while lacking durability and the ability to be used for unplanned situations. There is a clear need in the art for better connection systems that will address current limitations. Embodiments of the subject invention are suitable for precast UHPC structural elements and greatly improve construction efficiency and flexibility.

Figure 1:
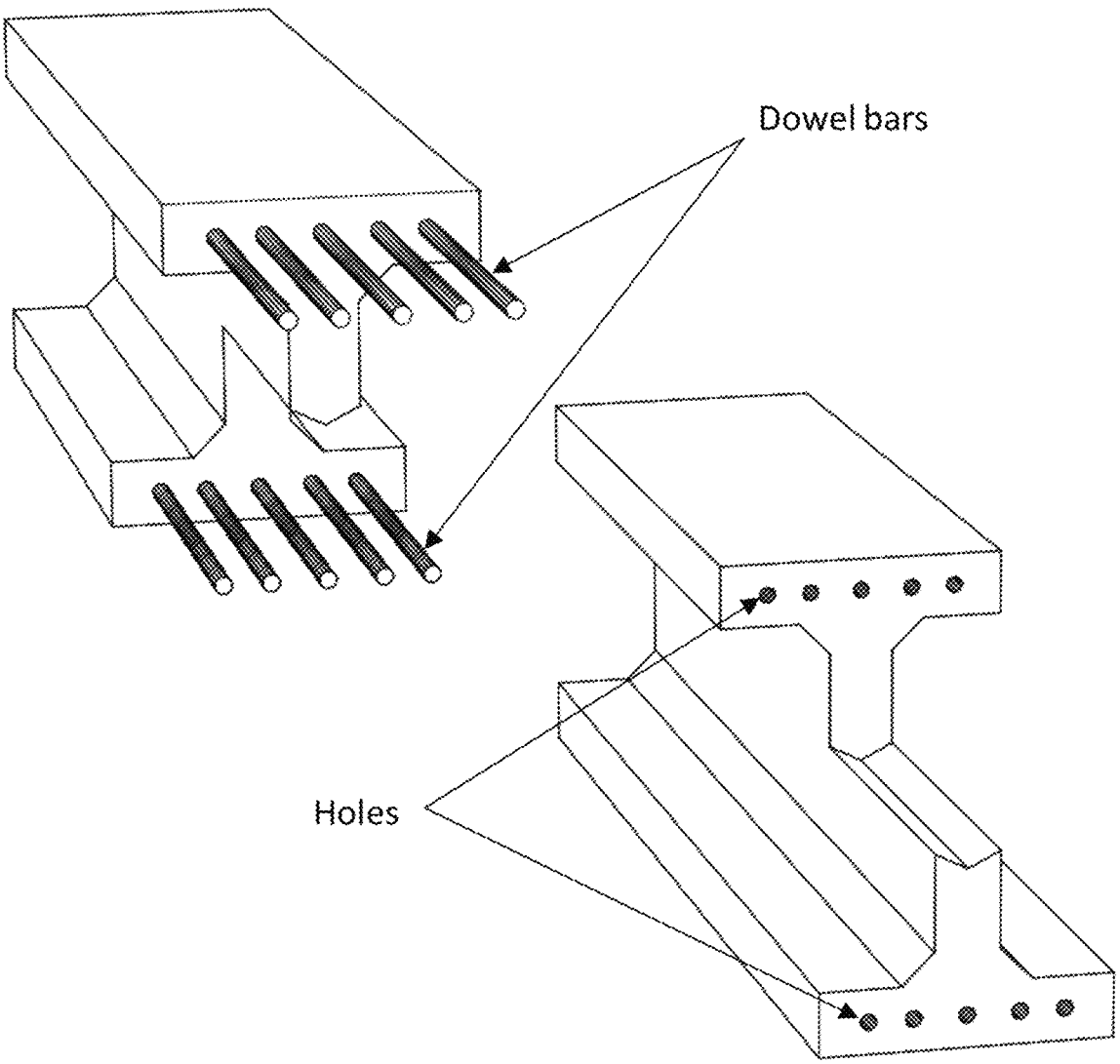
FIG. 1 shows a precast ultra-high-performance concrete (UHPC) element overhang connection structure, according to an embodiment of the subject invention.

FIG. 1 shows a precast UHPC element overhang connection structure, according to an embodiment of the subject invention, depicting prepared matching precast UHPC elements (each having an H-shaped cross section) with an overhang. One of the elements has dowel bars while the other element has holes configured to respectively receive/accept the dowel bars from the other element. The overhang connection configuration is designed to supplement dowel action in transferring the shear forces effectively by utilizing the extended portions of the precast elements, providing a robust and stable connection, as shown in FIG. 1.

Figure 2:
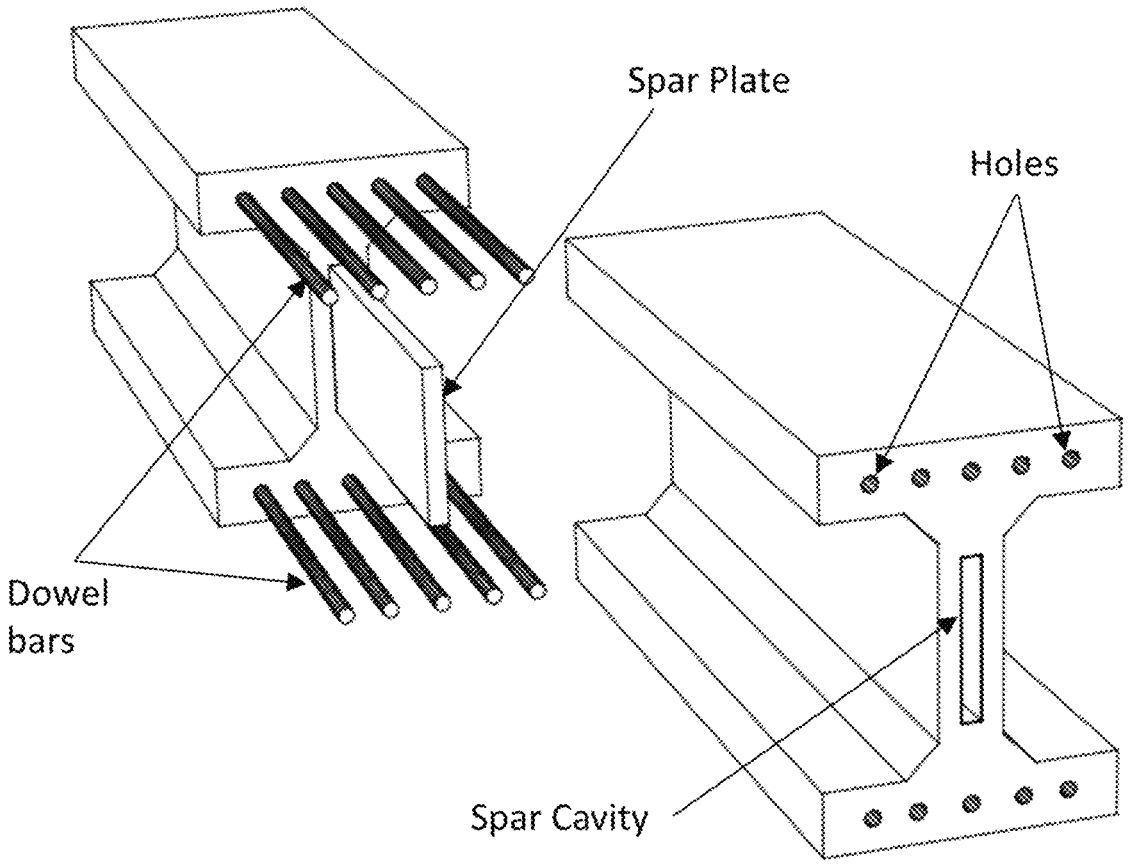
FIG. 2 shows a precast UHPC element spar connection structure, according to an embodiment of the subject invention.

FIG. 2 shows a precast UHPC element spar connection structure, according to an embodiment of the subject invention, depicting prepared matching precast UHPC elements (each having an H-shaped cross section) with a spar connection structure. One of the elements has dowel bars and a spar plate while the other element has holes configured to respectively receive/accept the dowel bars from the other element and also has a spar cavity configured to receive/accept the spar plate from the other element. The spar element connection employs spar elements to improve shear transfer and enhance the connection's performance in complex load scenarios, as shown in FIG. 2.

Figure 3:
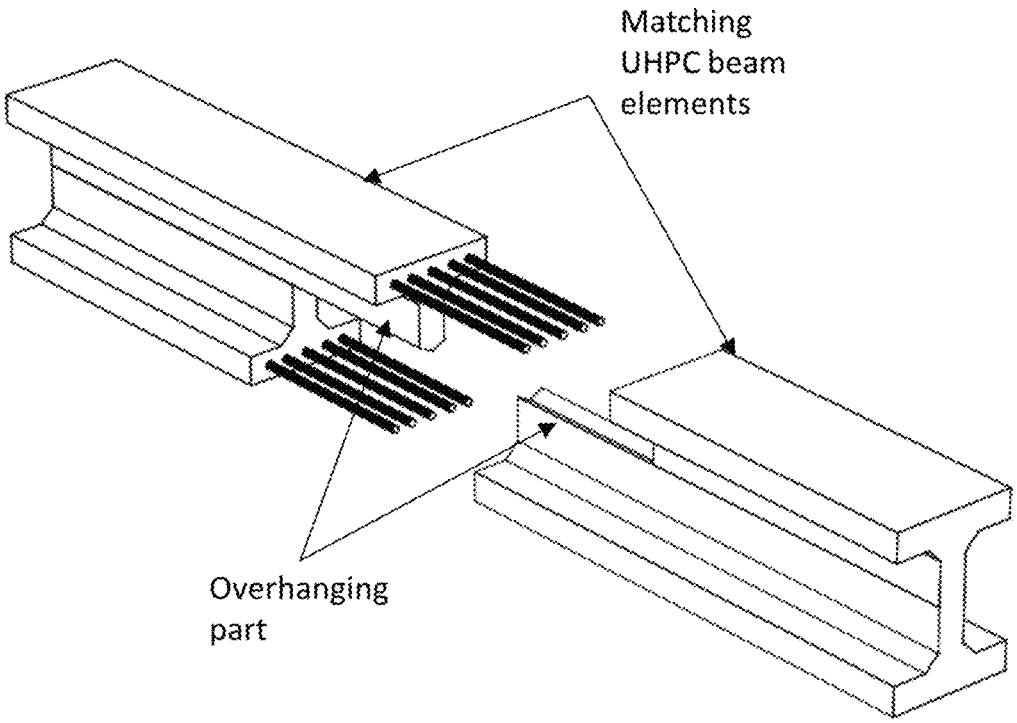
FIG. 3 shows a precast UHPC element overhang connection structure, according to an embodiment of the subject invention.
Figure 4:
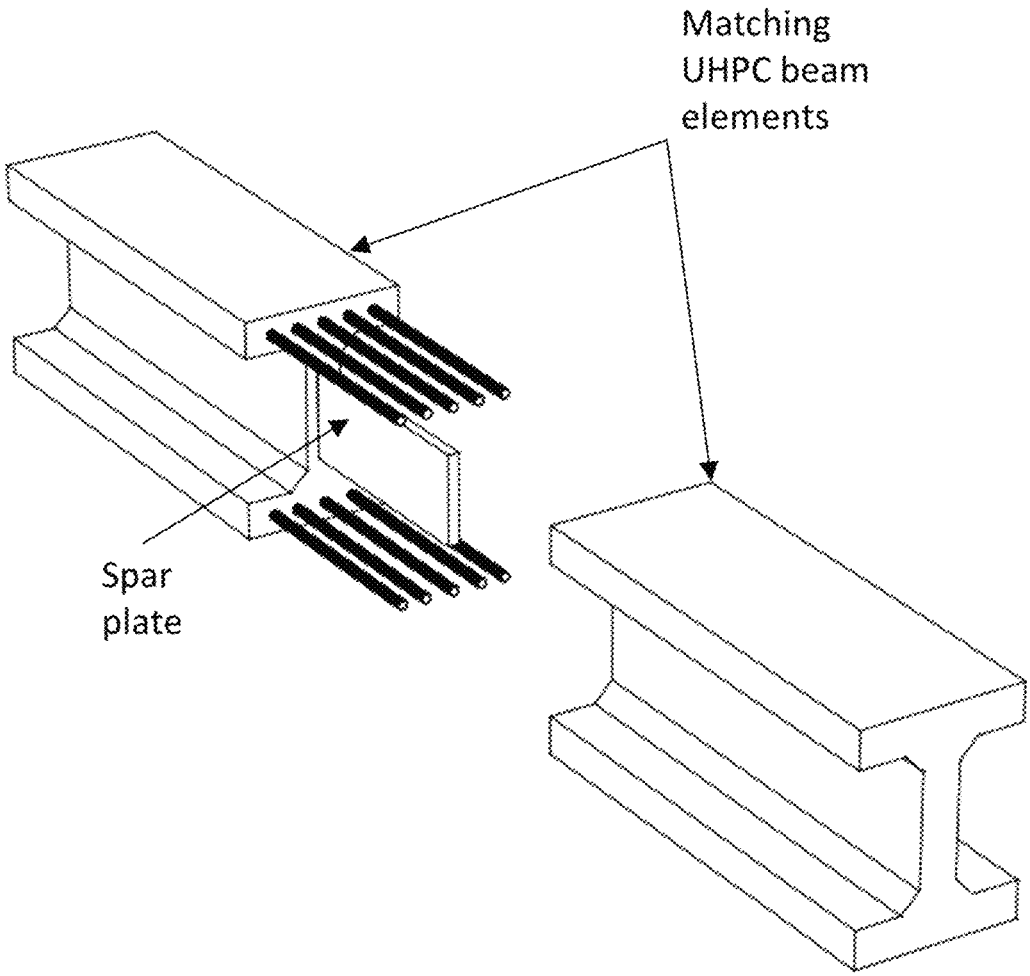
FIG. 4 shows a precast UHPC element spar connection structure, according to an embodiment of the subject invention.
Figure 5:
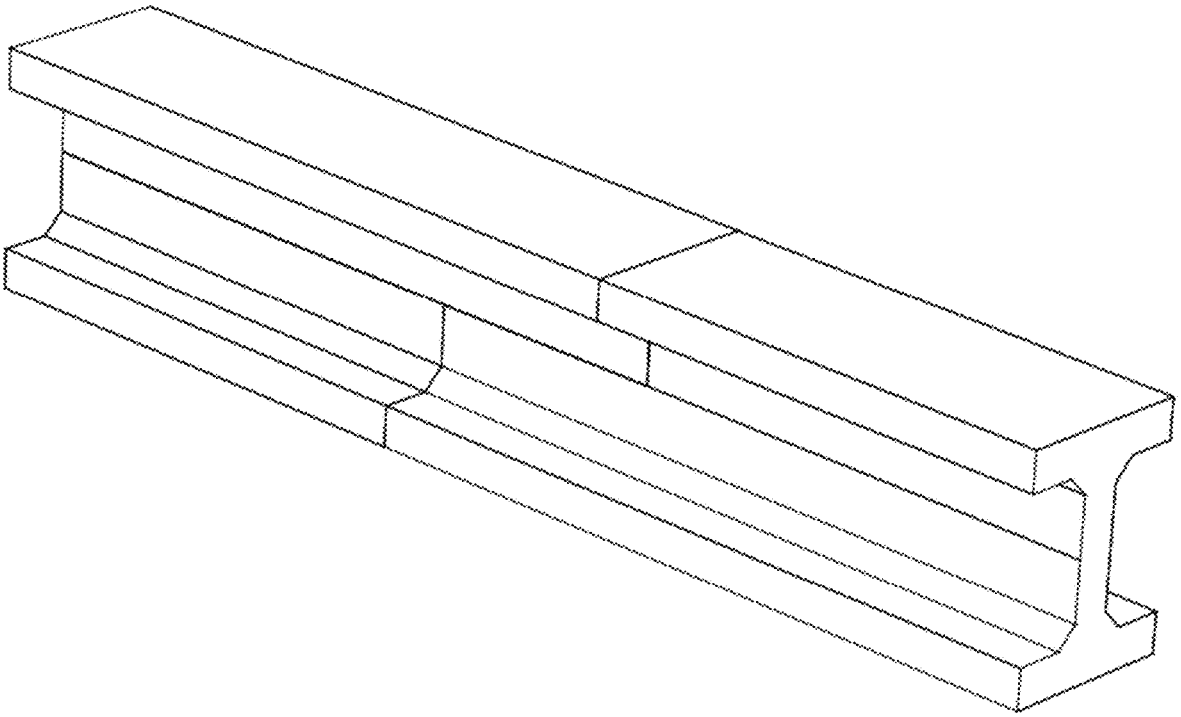
FIG. 5 shows a precast UHPC element overhang connection structure, according to an embodiment of the subject invention.
Figure 6:
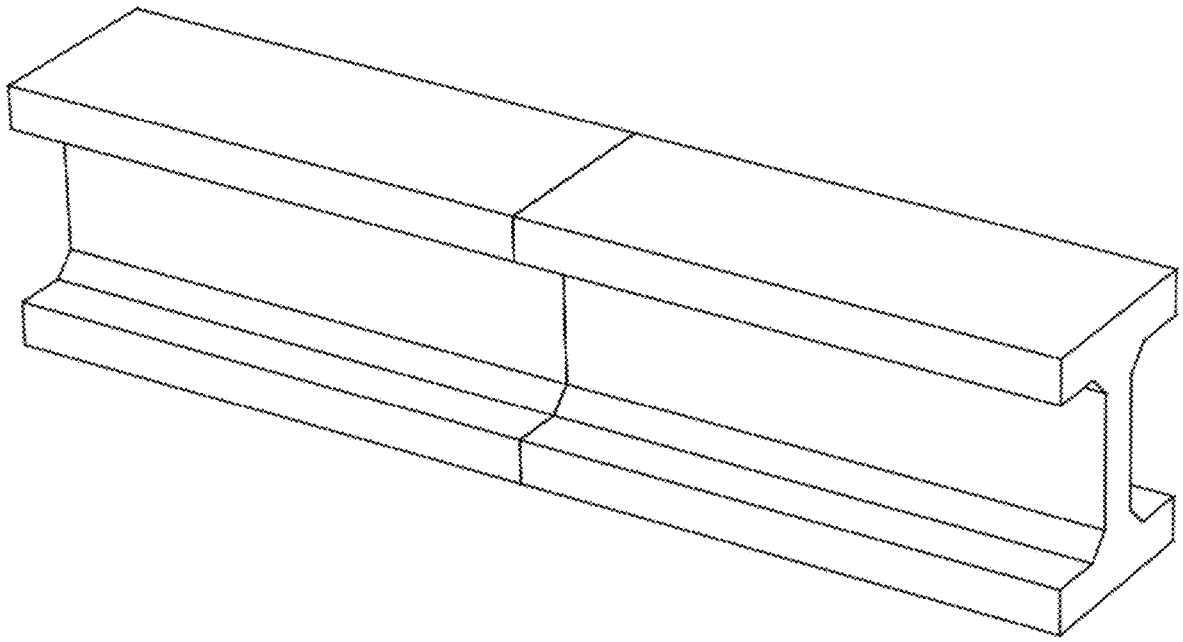
FIG. 6 shows a precast UHPC element spar connection structure, according to an embodiment of the subject invention.

In many embodiments, dowel bars (which can preferably be corrosion-resistant) can be included on a first face of a first UHPC element, holes can be included on a second face of a second UHPC element configured to respectively receive the dowel bars, a filler/bonding grout (e.g., epoxy, UHPC, and/or adhesive) can be disposed in the holes, and a connection structure (e.g., overhang connection structure or spar connection structure) can be included. The overhang connection structure can include: the first face of the first UHPC element having an extended portion such that some dowel bars are disposed on the extended portion and some other dowel bars are disposed on the non-extended portion (as seen in FIGS. 1 and 3); the second face of the second UHPC element having an extended portion such that some holes are disposed on the extended portion and some other holes are disposed on the non-extended portion (as seen in FIGS. 1 and 3); and the extended portion and the non-extended portion of the first UHPC element can be configured to match up with the non-extended portion and the extended portion, respectively, of the second UHPC element (as seen in FIGS. 1, 3, and 5). Referring to FIGS. 2, 4, and 6, the spar connection structure can include a spar plate disposed on the first face of the first UHPC element and a spar cavity on the second face of the second UHPC element configured to receive the spar plate (alternatively, the spar plate and spar cavity can be on the second face of the second UHPC element and the first face of the first UHPC element, respectively).

The dowel bars can be made from any suitable material, such as carbon steel, stainless steel, or composite materials (e.g., carbon fiber reinforced polymer (CFRP) or glass fiber reinforced polymer (GFRP)). The dowels must have adequate length to bond with the other beam member segment. Resin and cementitious grouts, as well UHPC, can be used as fillers and bonding agents. During an unplanned situation, dowel holes or a spar cavity can be formed in one of the matching UHPC beams (e.g., through drilling). Embodiments of the subject invention offer a durable and practical solution for joining precast UHPC beam elements, addressing the unique challenges faced in the construction industry. By leveraging the superior properties of UHPC and incorporating corrosion-resistant materials, the splicing method enhances the durability and performance of structural connections during use.

Embodiments of the subject invention provide systems and methods for connecting precast UHPC elements (e.g., with H-shaped cross sections) with epoxy-bonded dowels, offering a reliable and practical connection solutions. The structural integrity and long-term performance of precast UHPC components are critically dependent on the design of their joints and the selection of appropriate connection methods. A well-engineered joint design not only facilitates efficient assembly but also ensures the durability and optimal functionality of the entire precast system over its lifespan. With respect to shear transfer, embodiments include an overhang connection structure configuration and a spar element connection structure configuration.

The preparation procedure at a precast plant can include: designing the connection details (e.g., desired dowel and hole size and configuration); casting the precast UHPC structural element(s) in the precast plant with the dowel holes; and casting the dowel bars into the matching beam element(s) with the required length (based on the dowel hole size). The total embedment length of the dowel bars can be based on structural design and construction specification.

The onsite installation procedure can include: transporting the prepared precast UHPC elements (e.g., including the dowel bars, the cast holes, and the overhanging sections or spar element) to the designated location; cleaning the holes and the surfaces thoroughly to remove any debris from during transportation; applying the adhesive/grout to the matching surface areas of the precast UHPC beam elements; ensuring that the dowel holes (and spar cavity, if applicable) are generously filled with adhesive/grout to avoid formation of any void(s) (any excess adhesives/grout can be removed); inserting the protruding dowel bars from a segment into holes (and spar into the spar cavity, if applicable) in the matching segment and ensuring the parts are aligned as shown in FIGS. 3 and 4; and allowing time for the curing of the adhesive/grout (e.g., according to the supplier's specification) to establish a strong connection before usage, followed by inspecting for quality. The finished connected segments are shown in FIGS. 5 and 6.

Embodiments of the subject invention can be connected using an overhang connection structure or a spar connection structure to provide shear resistance in addition to axial and bending resistance. Embodiments can be used for various UHPC element shapes, including but not limited to UHPC elements with an H-shaped cross section. Embodiments can be used for structural elements of various applications (e.g., beam, column, pile, etc.). The connection system can use corrosion resistance reinforcement bars (dowel bars) that make the connection durable and suitable for construction in many environments, including a marine environment. The spar connection can apply to both planned and unplanned connection situations.

Existing methods for connecting UHPC precast elements with an H-shaped cross section during construction are complex, costly, and lack durability, while only being applicable in pre-planned situations. Embodiments of the subject invention provide a simple, ready-to-use solution that ensures the structural performance and efficiency of the connected elements throughout their use. Embodiments provide simplicity and efficiency, versatility, enhanced durability, cost-effectiveness, and adaptability. With respect to simplicity and efficiency, the connection is straightforward and ready-to-use while being labor-friendly and time-effective such that it can accelerate the construction process. With respect to versatility, unlike many alternatives, embodiments work for structural elements of various applications (e.g., beam, column, pile, etc.) while the spar connection can also be used for both preplanned and unplanned situations. With respect to enhanced durability, embodiments can use corrosion-resistant dowel bars and can require less maintenance (compared to related art systems and methods). This significantly improves performance in harsh environments, such as marine settings. With respect to cost-effectiveness, the simplicity and durability of the system contribute to overall cost savings in both installation and maintenance. With respect to adaptability, embodiments can be applied to various UHPC element designs, increasing utility across different project types.

Embodiments of the subject invention offer unique features that overcome the limitations of related art connecting systems/methods for UHPC. Embodiments are easily applicable to joining precast UHPC elements in building and other civil engineering structures, making them ideal for accelerated construction. The implementation can provide significant benefits to the precast industry. It is noted that in case of an unplanned situation (e.g., pile splicing in an unforeseen situation), the spar connection structure should be used, and the dowel holes and spar cavity should be created at the site.

When ranges are used herein, combinations and subcombinations of ranges (including any value or subrange contained therein) are intended to be explicitly included. When the term "about" is used herein, in conjunction with a numerical value, it is understood that the value can be in a range of 95% of the value to 105% of the value, i.e. the value can be +/−5% of the stated value. For example, "about 1 kg" means from 0.95 kg to 1.05 kg.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A system for connecting concrete structural elements, the system comprising:

a first concrete structural element comprising dowel bars extending in a first direction from a first face of the first concrete structural element;

a second concrete structural element comprising dowel holes formed in a second face of the second concrete structural element, the dowel holes being configured to respectively receive the dowel bars of the first concrete structural element; and a complementary connection structure that is an overhang connection structure, the first concrete structural element and the second concrete structural element each being an ultra-high-performance concrete (UHPC) precast structural element, the first concrete structural element comprising a third face opposite from the first face of the first concrete structural element, the first face of the first concrete structural element comprising a first extended portion and a first non-extended portion such that the first extended portion of the first face extends farther from the third face of the first concrete structural element than does the first non-extended portion, the second concrete structural element comprising a fourth face opposite from the second face of the second concrete structural element, the second face of the second concrete structural element comprising a second extended portion and a second non-extended portion such that the second extended portion of the second face extends farther from the fourth face of the second concrete structural element than does the second non-extended portion, the first extended portion and the first non-extended portion being configured to match up with the second non-extended portion and the second extended portion, respectively, when the first concrete structural element is connected to the second concrete structural element, thereby providing the overhang connection structure, the dowel bars being formed on both the first extended portion and the first non-extended portion, the dowel holes being formed on both the second extended portion and the second non-extended portion, and the dowel bars on the first non-extended portion overlapping the first extended portion in a second direction perpendicular to the first direction in which the dowel bars extend.

2. The system according to claim 1, the first concrete structural element and the second concrete structural element each having an H-shaped cross section, such that the first face of the first concrete structural element has an H-shape and the second face of the second concrete structural element has an H-shape.

3. The system according to claim 1, the first extended portion being extended away from the first non-extended portion by a first length, the second extended portion being extended away from the second non-extended portion by a second length, and the first length being the same as the second length.

4. The system according to claim 1, the dowel bars of the first concrete structural element being respectively inserted into the dowel holes of the second concrete structural element such that the first concrete structural element is connected to the second concrete structural element, and the system further comprising a cured adhesive material disposed in the dowel holes and in contact with the dowel bars.

5. The system according to claim 1, the dowel bars on the first extended portion extending farther from the third face of the first concrete structural element than do the dowels bars on the first non-extended portion.

6. A system for connecting concrete structural elements, the system comprising:

a first concrete structural element comprising dowel bars extending from a first face of the first concrete structural element;

a second concrete structural element comprising dowel holes formed in a second face of the second concrete structural element, the dowel holes being configured to respectively receive the dowel bars of the first concrete structural element; and a complementary connection structure that is an overhang connection structure, the first concrete structural element and the second concrete structural element each being an ultra-high-performance concrete (UHPC) precast structural element, the first concrete structural element and the second concrete structural element each having an H-shaped cross section, such that the first face of the first concrete structural element has an H-shape and the second face of the second concrete structural element has an H-shape, the dowel bars of the first concrete structural element being respectively inserted into the dowel holes of the second concrete structural element such that the first concrete structural element is connected to the second concrete structural element, the system further comprising a cured adhesive material disposed in the dowel holes and in contact with the dowel bars, the adhesive material comprising at least one of epoxy, UHPC, and bonding grout, the first concrete structural element comprising a third face opposite from the first face of the first concrete structural element, the first face of the first concrete structural element comprising a first extended portion and a first non-extended portion such that the first extended portion of the first face extends farther from the third face of the first concrete structural element than does the first non-extended portion, the second concrete structural element comprising a fourth face opposite from the second face of the second concrete structural element, the second face of the second concrete structural element comprising a second extended portion and a second non-extended portion such that the second extended portion of the second face extends farther from the fourth face of the second concrete structural element than does the second non-extended portion, the first extended portion and the first non-extended portion being configured to match up with the second non-extended portion and the second extended portion, respectively, when the first concrete structural element is connected to the second concrete structural element, thereby providing the overhang connection structure, the dowel bars being formed on both the first extended portion and the first non-extended portion, the dowel holes being formed on both the second extended portion and the second non-extended portion, and the dowel bars on the first non-extended portion overlapping the first extended portion in a second direction perpendicular to the first direction in which the dowel bars extend.

7. The system according to claim 6, the first extended portion being extended away from the first non-extended portion by a first length, the second extended portion being extended away from the second non-extended portion by a second length, and the first length being the same as the second length.

8. The system according to claim 6, the dowel bars on the first extended portion extending farther from the third face of the first concrete structural element than do the dowels bars on the first non-extended portion.

* * * * *